United States Patent [19]

Faddis et al.

[11] Patent Number: 4,621,574

[45] Date of Patent: Nov. 11, 1986

[54] DUAL FORM PLANETARY INKER

[75] Inventors: Terry N. Faddis; Howard L. Propheter; Thomas D. Parks, all of Emporia, Kans.

[73] Assignee: Didde Graphic Systems Corporation, Emporia, Kans.

[21] Appl. No.: 720,364

[22] Filed: Apr. 5, 1985

[51] Int. Cl.[4] ..... B41F 7/04; B41F 31/14

[52] U.S. Cl. ..... 101/142; 101/350; 101/352

[58] Field of Search ..... 101/349, 350, 351, 352, 101/142, 148, 217, 207–210, 177, 148

[56] References Cited

U.S. PATENT DOCUMENTS

| | | | |
|---|---|---|---|
| 3,029,729 | 4/1962 | Gericke | 101/351 |
| 3,039,386 | 6/1962 | Trisler | 101/148 X |
| 3,279,371 | 10/1966 | Mestre | 101/352 |
| 3,304,863 | 2/1967 | Jurny | 101/351 |
| 3,508,489 | 4/1970 | Norton | 101/148 |
| 4,223,603 | 9/1980 | Faddis et al. | 101/350 |

FOREIGN PATENT DOCUMENTS

| | | | |
|---|---|---|---|
| 678543 | 7/1939 | Fed. Rep. of Germany | 101/148 |
| 1598266 | 9/1981 | United Kingdom | 101/148 |
| 2091641 | 8/1982 | United Kingdom | 101/148 |

*Primary Examiner*—J. Reed Fisher

*Attorney, Agent, or Firm*—Schmidt, Johnson, Hovey & Williams

[57] ABSTRACT

An offset printing press is provided with a novel dual form planetary inker having improved printing characteristics. In use, a plate cylinder rotates to initially contact an ink/water form roller and subsequently contact a second form roller which is devoted exclusively to ink. The ink form roller is operable to insure that voids caused by lint, dust and other debris in the ink train are covered by the second form roller; additionally, the ink form roller provides a second working nip through which a second layer of ink is averaged with the previously deposited ink layer, such that ghosting is substantially eliminated. Both of the form rollers as well as numerous distributor rollers are rotatably carried by a shiftable frame which is pivotally interconnected with a support that carries the plate cylinder. The frame is shiftable from a first position wherein the forms are in rolling engagement with the plate cylinder and a second position wherein both of the forms are spaced from the plate cylinder; however, as the frame is lowered toward its first or working position, the ink/water form is disposed to contact the plate cylinder before the ink form, such that the plate is effectively dampened before ink is applied thereto. In particularly preferred forms, the planetary inker engages the plate cylinder on only two lines of contact, such that any one of a number of various plate cylinder diameters may be utilized.

3 Claims, 5 Drawing Figures

12
INK and WATER FORM
VIBRATOR
RIDERS
VIBRATOR
TRANSFER ROLLER
PAN ROLLER
RIDERS
VIBRATOR
RIDERS
RIDERS
DUCTOR
INK BALL
VIBRATOR
INK FORM
PLATE CYL.
BLANKET CYL.
IMPRESSION CYL.
-10-

12
INK and WATER FORM
TRANSFER ROLLER
PAN ROLLER
VIBRATOR
INK FORM
DUCTOR
VIBRATOR
PLATE CYL.
INK BALL
BLANKET CYL.
42
40
38
36
34
43
32
28
30
26
24
22
150
148
14
14a
16
88
89
85
84
87
86

DUAL FORM PLANETARY INKER

BACKGROUND OF THE INVENTION

1. Field of the Invention

This invention relates to an improved planetary inker for an offset lithographic printing press wherein an ink form roller and an ink/water form roller provide improved printing quality as well as versatility of plate cylinder size.

2. Description of the Prior Art

Clear, high-quality printing can be obtained from an offset lithographic press only when two substances are supplied to the printing plate in a proper, proportional relationship. The first substance is the dampening fluid or so-called "water", which is actually a solution of water, gum arabic, and a number of other chemicals which have an attraction to the hydrophilic, or non-image areas of the printing plate. The second essential substance in the printing process is the ink, which is an oil based solution comprised of carrying vehicles, pigments, dryers and a range of other miscellaneous ingredients that when combined form a solution having a strong attraction for the oleophilic, or ink receptive image areas of the printing plate.

Typically, severe demands are placed upon the inking system of an offset press. First, the viscous ink must be milled from a thick, plastic state into a thin film around all of the form rollers. Secondly, the ink must then be transferred from the form rollers to a uniform, even film of ink on the image areas of the plate. Additionally, the inking system should pick up particles of lint and other foreign matter from the plate cylinder so that the final printed image on the paper is free of defects.

The inking system should also be operable to fully replenish ink to all image areas of the plate during each revolution of the latter; otherwise, "ghosting" will occur. Ghosting is often encountered on printing which requires large amounts of heavy ink coverage in combination with areas requiring little or no ink coverage. Because the form is usually of different diameter than the plate, ink-deficient areas of the form cause a latent, repeat image to appear at a position different than the original location when the form completes a second revolution.

U.S. Pat. No. 4,223,603 to Faddis, et al. discloses a gear driven planetary inker which is operable to minimize ghosting and deliver a uniform film of ink to the plate cylinder. In brief, the planetary inker of this patent has single form roller in rolling contact with the plate cylinder, and also a number of varisized distributor rollers disposed in rolling contact about the perimeter of the form roller. The distributor rollers include a number of non-oscillable rider rollers which provide ink storage and effect milling of the ink. Also, the distributor rollers include a number of longitudinally oscillable vibrator rollers which mill the ink, provide additional ink storage, and distribute the ink from side to side. The planetary inker is superior to other inkers because as the form roller makes one complete revolution, the large number of nips between the form and the various distributor rollers insure that the ink film is fully replenished and that the film is milled to a uniform thickness.

Typically, single form planetary inkers have been associated with conventional dampening systems wherein a ductor roller oscillates between alternating positions of engagement with a water pan roller and a distributor roller which transmits water to the plate cylinder. Unfortunately, the oscillating nature of the ductor roller slows the response of the dampening system such that the press produces additional waste in coming to equilibrium.

Other types of offset presses in the past have used continuous dampening systems wherein the oscillating ductor roller is eliminated. Instead, the dampening solution is applied to a water dedicated form roller which is in continuous, rolling contact with the plate cylinder. It is an important function of the continuous as well as the conventional dampening system to apply water to the nonprinting areas of the plate before the latter contacts the ink form roller to insure that the plate resists ink deposition in the non-image areas.

SUMMARY OF THE INVENTION

The dual form planetary inking system of the present invention provides significant advantages over the single form planetary inker utilized the past. The utilization of a second form in rolling contact with the plate insures that voids in the ink coverage caused by lint, dust and other foreign matter in the ink when deposited by the first form roller whereby the final high quality printed image is essentially free of defects. Furthermore, the forms are operable to provide a one-hundred percent ink transfer to the plate at all times so that ghost images do not occur.

In more detail, one of the forms is dedicated to provide ink to the plate while the other form provides both ink and water to the plate. Both forms have a number of varisized distributor rollers positioned therearound in a planetary configuration and one of the distributor rollers serves as a bridging roller which contacts both of the forms. Additionally, a certain quantity of the distributor rollers are oscillable vibrator rollers, while others are non-oscillable rider rollers.

The ink/water form is in rolling engagement with a transfer roller which supplies dampening solution from a water pan roller. On the other hand, the ink form is in rolling contact with a vibrator roller which, in turn, receives ink from an oscillable ductor roller that intermittently shifts between a position of engagement against the vibrator and a second position contacting an ink ball.

In use, both image and non-image areas of the plate cylinder first engage the ink/water form which is operable to simultaneously provide an ink and water film on the areas of the plate cylinder. As the plate continues to rotate, the latter next contacts the ink form which supplies additional ink to the image areas of the plate. At the same time, the ink form insures that voids caused by lint and other debris in the ink train are provided with ink such that the final printed image on the paper is substantially free of "hickies" or other inker related defects.

The utilization of an ink form in association with an ink/water form also advantageously eliminates image defects that would otherwise occur due to irregularities of the form roller surface. The use of two form rollers to supply ink to the plate tends to average the film thickness, and any uneven film deposits created by the first roller are essentially equalized due to the application of the second ink layer. Repeat ghosting is substantially eliminated because the ink film is completely milled to a uniform, even layer during rotation of the two form rollers; yet, the distributor rollers are operable to rapidly replenish the ink in the image areas where the ink demands are substantial.

Another novel feature of the instant invention is the utilization of a shiftable frame which carries not only both of the forms but also all of the distributor rollers. In contrast, the plate, blanket and impression cylinders as well as web handling rollers are carried by a stationary upright support. The frame is pivotally coupled to the support, such that movement of the frame shifts all of the form rollers and distributor rollers simultaneously away from the plate. By comparison, prior art offset presses have typically utilized a mechanism to pivot each of the form rollers individually, although such mechanism would be a decided disadvantage, if not impractical, with planetary inking systems wherein a multitude of distributor rollers are normally positioned around the form.

Moreover, the forms of the instant invention are disposed on the shiftable frame such that as the latter is moved away from the plate, the ink form disengages the plate before the ink/water form disengages the same. On the other hand, as the frame is shifted toward the plate, the ink/water form engages the plate ahead of the ink form. As a result, the plate cylinder will invariably have a sufficient amount of water before engaging the ink form, as it is of utmost importance to initially wet the non-image areas of the plate to resist the deposition of ink. In preferred forms, the ink/water form moves in an approximate tangential relation to the plate cylinder, while the ink form moves generally radially of the plate such that proper contact of the forms in timed relation is insured.

Also noteworthy is the fact that the dual form planetary inker as provided herein contacts the plate along only two nip lines. Thus, the diameter of the plate cylinder may be changed as needed. Such a versatility in plate size is not readily available in tradotional presses having three or more rollers around the plate, since a cylinder is mathematically defined and thus fixed in diameter once three non-linear points (or nip lines) are established.

DETAILED DESCRIPTION OF THE DRAWINGS

Figure 1:
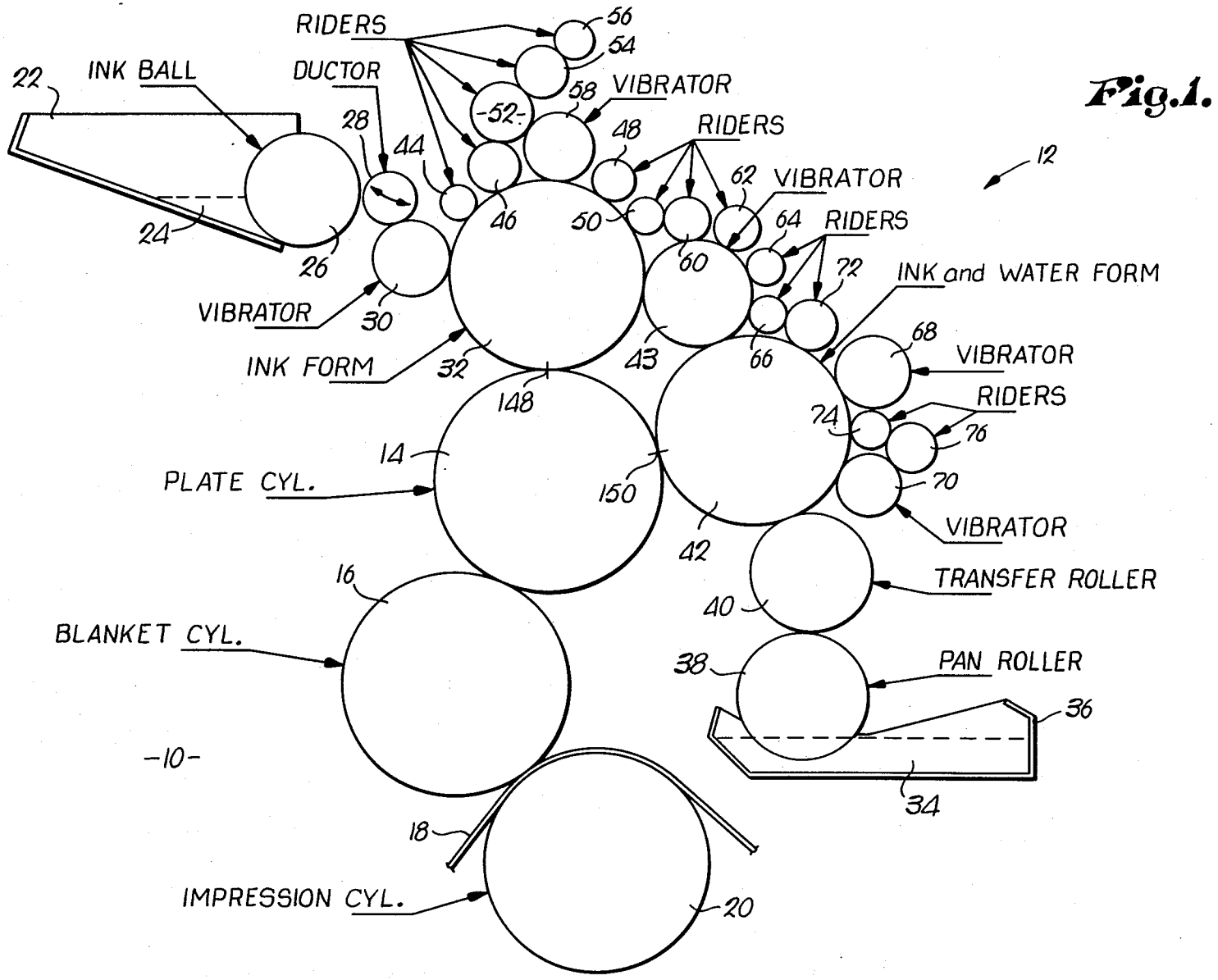
FIG. 1 is a side schematic showing of the roller train of a dual form planetary inker embodying the preferred principals of the present invention.

An offset lithographic printing press is indicated generally by the numeral 10 in FIGS. 1–5, wherein a dual form planetary inker 12 provides both ink and dampening solution to a plate cylinder 14. The image from the plate 14 is transferred to a blanket cylinder 16 which in turn deposits the ink on a web 18, the latter of which passes through a nip between the blanket cylinder 16 and an impression cylinder 20 therebeneath.

In more detail, the inker 12 as seen in FIG. 1 includes an ink fountain 22 which contains a quantity of viscous ink 24 therein. A conventional, cylindrical ink "ball" 26 is rotatable adjacent an inclined bottom of the fountain 22 such that a quantity of ink is picked up and adheres to the surface of the ink ball 26 as the latter is rotated.

Ink from the ink ball 26 is transferred to a rotatable ductor roller 28 which oscillates between positions of rolling engagement with the ball 26 and a vibrator roller 30. The vibrator roller 30 is operable to longitudinally oscillate during rotation thereof. In turn, the vibrator roller 30 transfers the ink to a rubber covered ink form roller 32 which is normally in rolling contact with the plate cylinder 14.

The press 10, as seen in FIG. 1, also includes a dampening system wherein a quantity of dampening solution or water 34 is contained within a fountain 36. A rubber coated pan roller 38 rotates partially within the water fountain 36 and carries water upwardly toward a chrome-plated transfer roller 40 in rolling engagement with the pan roller 38. In turn, the transfer roller 40 is in rolling engagement with a rubber coated ink/water form roller 42, the latter of which is also normally in rolling contact with the plate cylinder 14.

A longitudinally oscillable vibrator roller 43 is in rolling, surface contact with both the ink form 32 and the ink/water form 42. The vibrator 43 provides a path for the ink to flow from the ink form 32 to the ink/water form 42.

Independent metal rider rollers 44, 46, 48 and 50 ride against the surface of the ink form 32 between the vibrator 30 and the vibrator 43. The roller 46 also rides against the surface of a rider roller 52 which, in turn, is in rolling engagement with a rider roller 54. An outer independent rider roller 56 rotates in surface contact with the roller 54. A longitudinally oscillable vibrator 58 is in rolling engagement with both the rider roller 52 and the ink form 32.

A set of metal rider rollers 60, 62, 64 and 66 all rotate in rolling contact with the vibrator 43. Additionally, the rider roller 60 rides against the surface of rider roller 50.

A pair of longitudinally oscillable vibrator rollers 68, 70 are disposed for rolling engagement with the ink/water form 42. A rider roller 72 is positioned for rolling engagement with both the rider roller 66 and the ink/water form 42. Also, a rider roller 74 is in rolling contact with the ink/water form 42 and an outer rider roller 76, the latter of which is rotatable in surface engagement with both the rider roller 74 and the vibrator roller 70.

Figure 3:
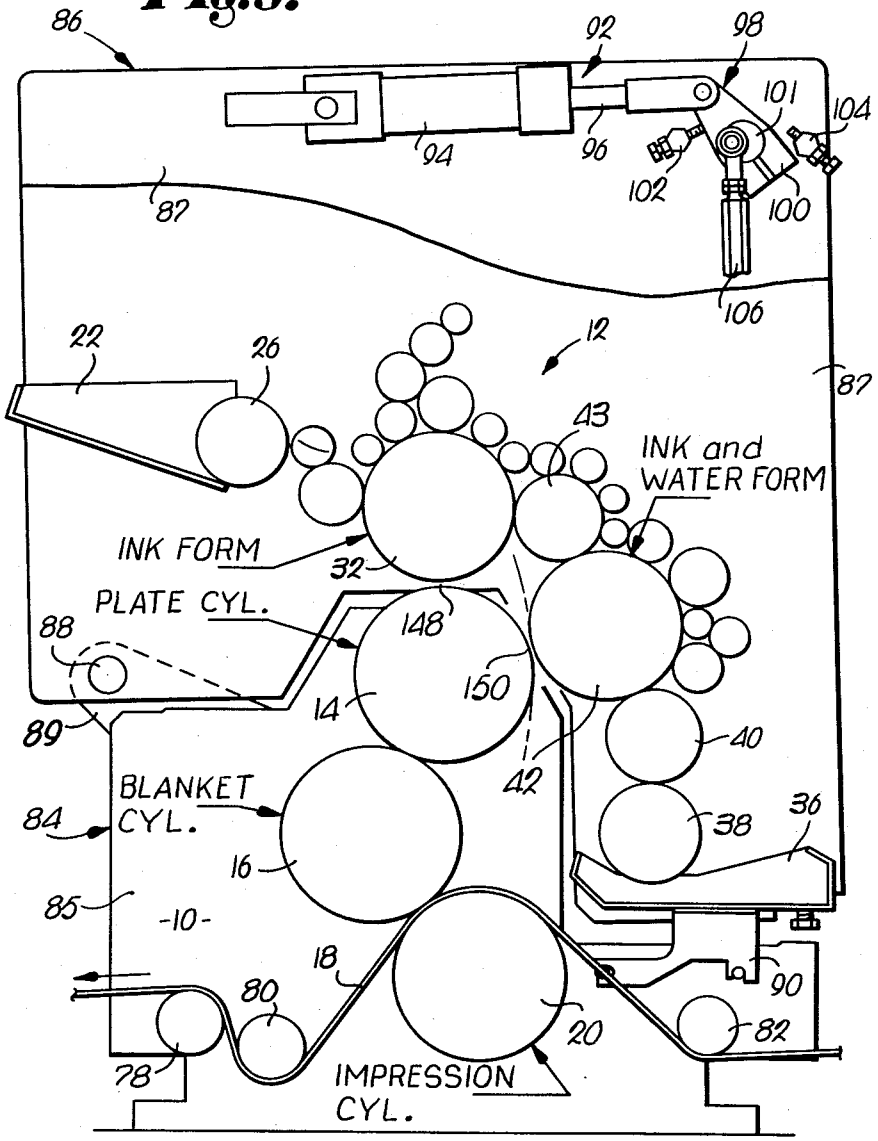
FIG. 3 is a view similar to FIG. 2 wherein the frame is shifted to move the forms away from the plate.
Figure 2:
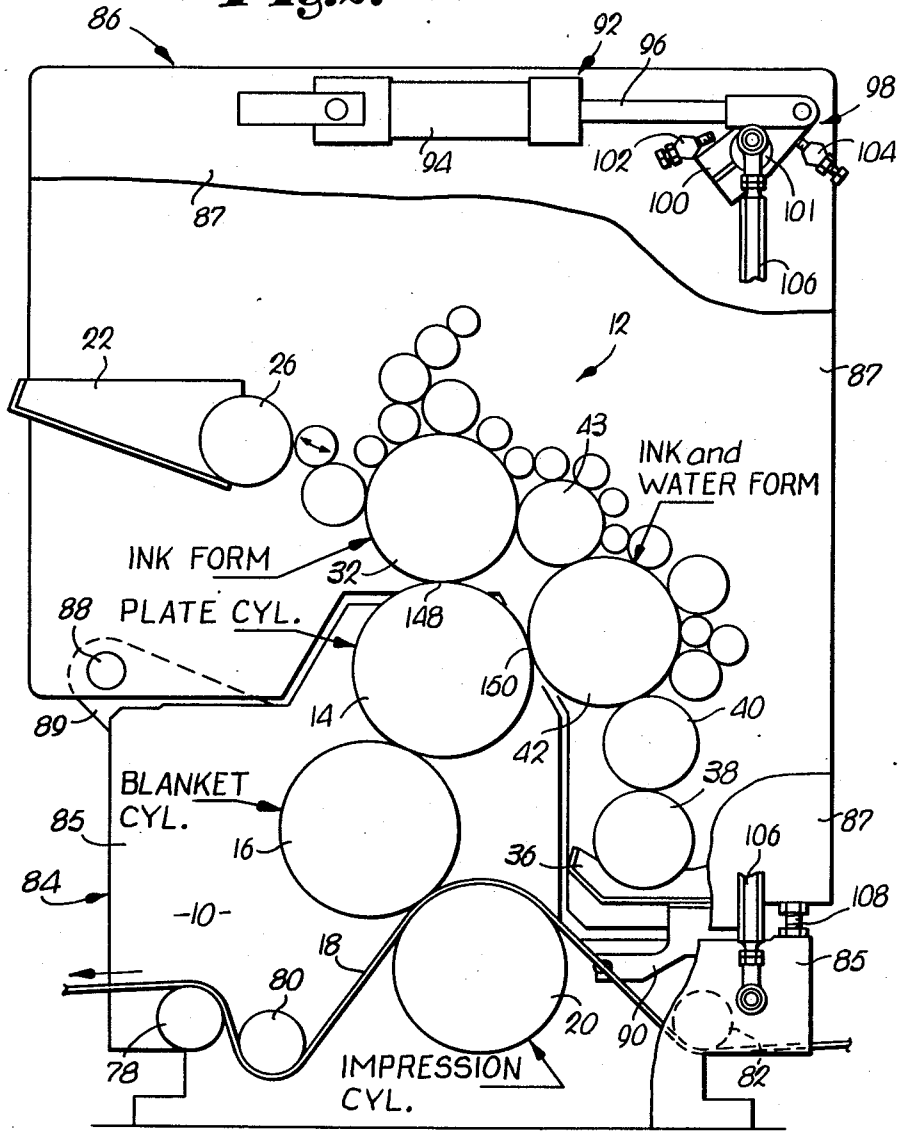
FIG. 2 is a side elevational, reduced, fragmentary view of the planetary inker illustrated in FIG. 1, depicting a cutaway, schematic view of the roller train.

Referring now to FIGS. 2 and 3, the press 10 includes an upright, lower support 84 and an upper frame 86 that is swingably interconnected to a laterally extending portion 89 of the support 84 by means of a pivot 88. The support 84 includes a pair of parallel, spaced, essentially identical flat sides 85, 85, only one of which is shown in the drawings. The plate cylinder 14, the blanket cylinder 16, and the impression cylinder 20 as well as a set of three web handling rollers 78, 80 and 82 are all rotatably carried by the sides 85, 85 therebetween.

The frame 86 also includes a pair of parallel, spaced, essentially identical flat sides 87, 87 (only one shown). The forms 32, 42, the ink ball 26, the ductor 28, the vibrator rollers 30, 43, 58, 68, 70, the pan roller 38, the transfer roller 40 and the rider rollers 44–56, 60–66 and 72–76 are all rotatably supported by the sides 87, 87 therebetween. Additionally, the ink fountain 22 is carried by the frame 86, while the water fountain 36 is secured to a bracket 90 which fixedly engages the support 84.

A pneumatically actuable piston and cylinder assembly 92 includes a cylinder 94 which is mounted on the side 87 and an elongated piston 96 which is shiftably received by the cylinder 94 for longitudinal movement. A toggle assembly 98 is pivotally connected to an end of the piston 96 remote from the cylinder 94 and includes a swingable arm 100 which is shiftable between a pair of stops 102, 104.

The arm 100 is secured to a rotatable shaft 101 which protrudes through both of the sides 87, 87. An elongated link 106 is pivotally coupled at one end thereof to an off-center location on the shaft 101, and an opposite end of the link 106 is pivotally connected to the side 85 of the support 84. Also, an adjustable stop 108 limits the downward path of travel of the frame 86 about the pivot 88. Although not shown, a second link identical to the link 106 is similarly connected to the shaft 101 and the support 84 at the opposite side of the press 10.

Figure 4:
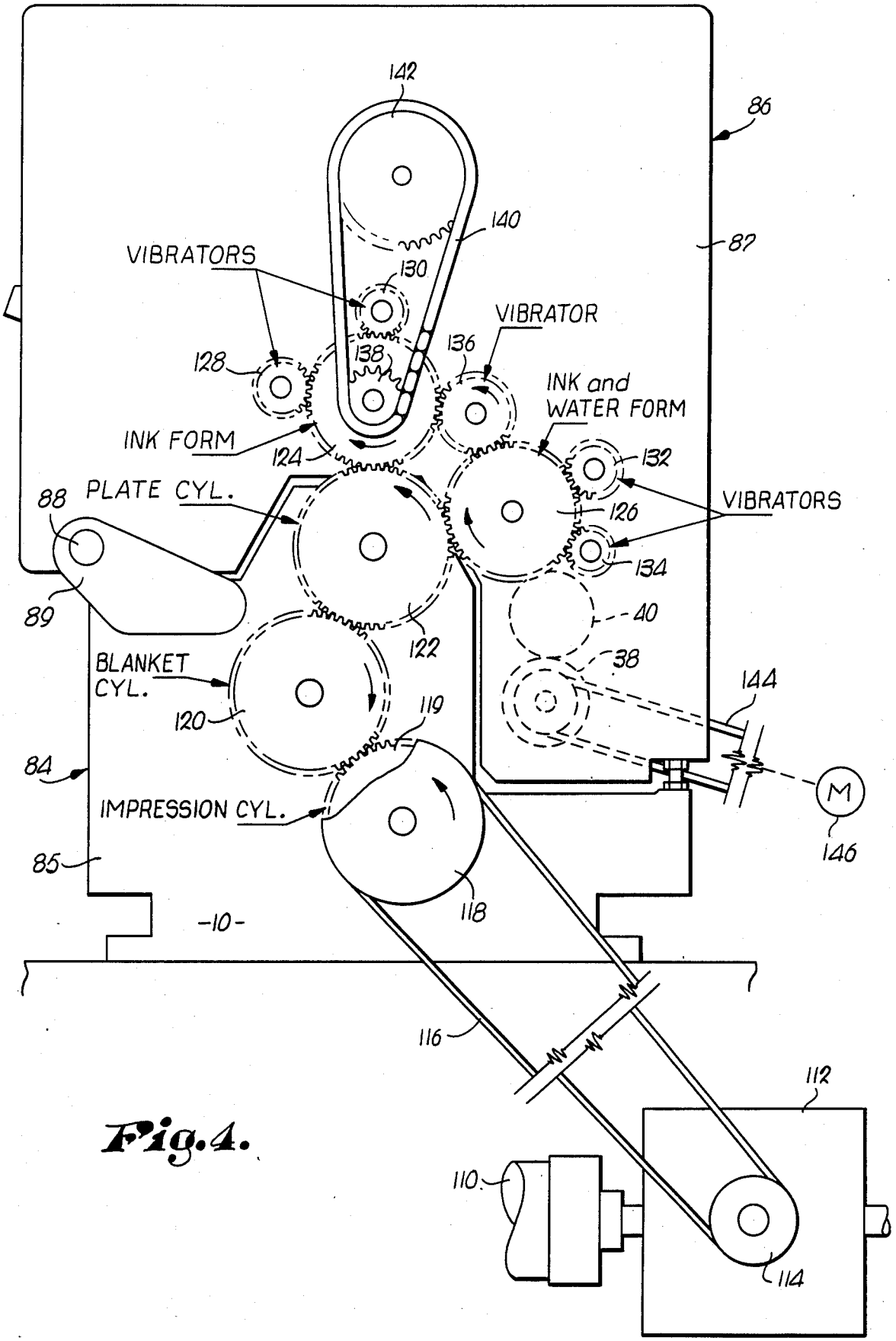
FIG. 4 is a reduced, side elevational view of the planetary inker shown in FIG. 1, illustrating a preferred gear drive train.

As illustrated schematically in FIG. 4, the press 10 is operably driven by a line shaft 110 which advantageously is interconnected with other printing towers (not shown) for synchronous movement therewith. A right angle drive 112 operably connected to the line shaft 110 includes a pulley 114 around which a belt 116 is trained. The belt 116 is also trained about a pulley 118 which is fixedly connected to one end of the impression cylinder 20. The impression cylinder 20 also is fixedly coupled to a gear 119 which meshingly engages a gear 120 that is connected to the blanket cylinder 16, and in turn, the gear 120 meshingly drives a gear 122 that is secured to one end of the plate cylinder 14.

The gear 122 drivingly engages a gear 124 connected to the ink form 32, and also a gear 126 that is coupled to the ink/water form 42. In turn, the gear 124 meshingly engages gears 128 and 130 which are fixedly connected to the vibrator rollers 30 and 58 respectively. The gear 126 operably drives gears 132 and 134 which are secured to the vibrators 68 and 70 respectively. Furthermore, the gear 124 intermeshingly engages the gear 136 which is coupled to the bridging vibrator roller 43.

Additionally, the gear 124 carries a small sprocket 138 about which a roller chain 140 is trained. In turn, the chain 140 operably rotates a large sprocket 142 which is coupled to a mechanism (not shown) for oscillation of the ductor 28 between positions of sequential engagement with the vibrator roller 30 and the ink ball 26.

The water pan roller 38 is independently driven by a belt 144 which is moved along an endless path of travel by a motor 146. The pan roller 38 is secured to a gear (not shown) which meshingly engages a second gear (also not shown) fixed to one end of the transfer roller 40.

Operation

As shown in FIG. 2, the frame 86 of the press 10 is moved for printing about the pivot 88 by activation of the piston and cylinder assembly 92 such that the piston 96 is fully extended and the toggle assembly 98 lowers the frame 86 until the stop 108 rests against the support 84. In this first position of the frame 86, the plate cylinder 14 is in rolling contact with both the ink form 32 and the ink/water form 42 along a nip line 148 and 150 respectively.

Referring to FIG. 3, the frame 86 is raised during printing interruptions by activation of the piston and cylinder assembly 92, such that the retraction of the piston 96 swings the arm 100 and thus exerts a force on the links 106, 106 until the frame 86 shifts upwardly and the stop 108 disengages the support 84. The frame 86 moves upwardly until reaching a second position wherein both the ink form 32 and the ink/water form 42 are spaced from the plate cylinder 14, wherein the gap at 148 is approximately 1/16" and the gap at 150 is approximately 1/32".

The unique construction of the pivotal movement of the frame 86 about the pivot 88 provides for simplicity of construction heretofor unknown in the art. In prior art inkers, the forms are individually shiftable away from the plate cylinder. However, construction of the press can be greatly simplified by the instant invention wherein all of the form rollers, the vibrator rollers and the rider rollers are mounted on a shiftable frame, such that the rotational axis of the ink form 32, the ink/water form 42 as well as the remaining rollers mounted on the frame 86 remain fixed relative to each other. Consequently, the various nips between the vibrator or rider rollers and the form rollers need not be disturbed.

As illustrated by the dashed line in FIG. 3, the ink/water form 42 moves in approximately tangential relation to the plate cylinder 14 as the frame 86 is moved about the pivot 88. The angular relation of the forms 32, 42 to the plate cylinder 14 and the pivot 88 provide that the ink/water form 42 engages the plate cylinder 14 before the ink form 32 engages the plate cylinder 14 when the frame 86 is shifted downwardly. Advantageously, a plane containing the rotational axes of the ink/water form 42 and the plate cylinder 14 is disposed at an angle of $14\frac{1}{2}°$ relative to a plane extending through the pivotal axis of the pivot 88 and the rotational axis of the plate cylinder 14.

Consequently, the tangential relation of the movement of the ink/water form 42 to the plate cylinder 14 insures that the latter is always supplied with dampening fluid before the ink form 32 is in a position for contact with the plate cylinder 14, and thus the plate 14 will be properly dampened to resist ink deposition in non-image areas. Noteworthy is the fact that the gear 122 connected to the plate cylinder 14 continues to meshingly engage and operably drive the gears 124, 126 of the forms 32, 42 respectively when the frame 86 is shifted towards its uppermost, second position, whereby the forms 32, 42 continue to rotate during disengagement from the plate cylinder 14. Preferably, when lowering the frame 86, the piston and cylinder assembly 92 is actuated at a slow rate such that the plate cylinder 14 rotates a complete revolution after engaging the ink/water form 42 but before engaging the ink form 32.

During printing, the vibrator rollers 30, 43, 58, 68, 70 and the rider rollers 44–56, 60–66 and 72–76 are, in effect, distributing rollers which assure complete smoothing out of the ink supplied to the form rollers 32, 42, such that the ink film thereon is of a extremely uniform nature before transfer to the plate cylinder 14. Also, the various sized distributor rollers provide ink storage such that sufficient ink may be rapidly transferred to certain image areas of the plate cylinder 14 which require large amounts of ink. The vibrator rollers 30, 43, 58, 68 and 70 also distribute the ink from side to side during oscillation and rotation thereof.

The dual form planetary inker 12 offers significant advantages over the single planetary as well as other types of inking devices common in the art. The utilization of two form rollers 32, 42 which provide ink to the plate cylinder 14 insure that all image areas of the latter have received sufficient ink. Furthermore, the form rollers 32 and 42 are operable to insure that voids caused by lint, dust and other foreign material are provided with ink such that the final printed image on the paper is substantially free of "hickies" or other inker related defects. Also, although surface irregularities may exist in either of the forms 32, 42, the plate 14 is nevertheless effectively inked due to the averaging effects of the two nips 148, 150.

Noteworthy also is the fact that the bridging vibrator roller 43 provides ink to the ink/water form 42 from the ink form 32. Thus, a single ink train, starting with the ink ball 26, feeds ink to both of the forms 32, 42, in contrast to a construction merely utilizing a pair of single planetary inkers of the type disclosed in the above-referenced patent, U.S. Pat. No. 4,223,603. The instant invention incorporates only a single ink train such that maintenance as well as capital costs are accordingly reduced.

Figure 5:
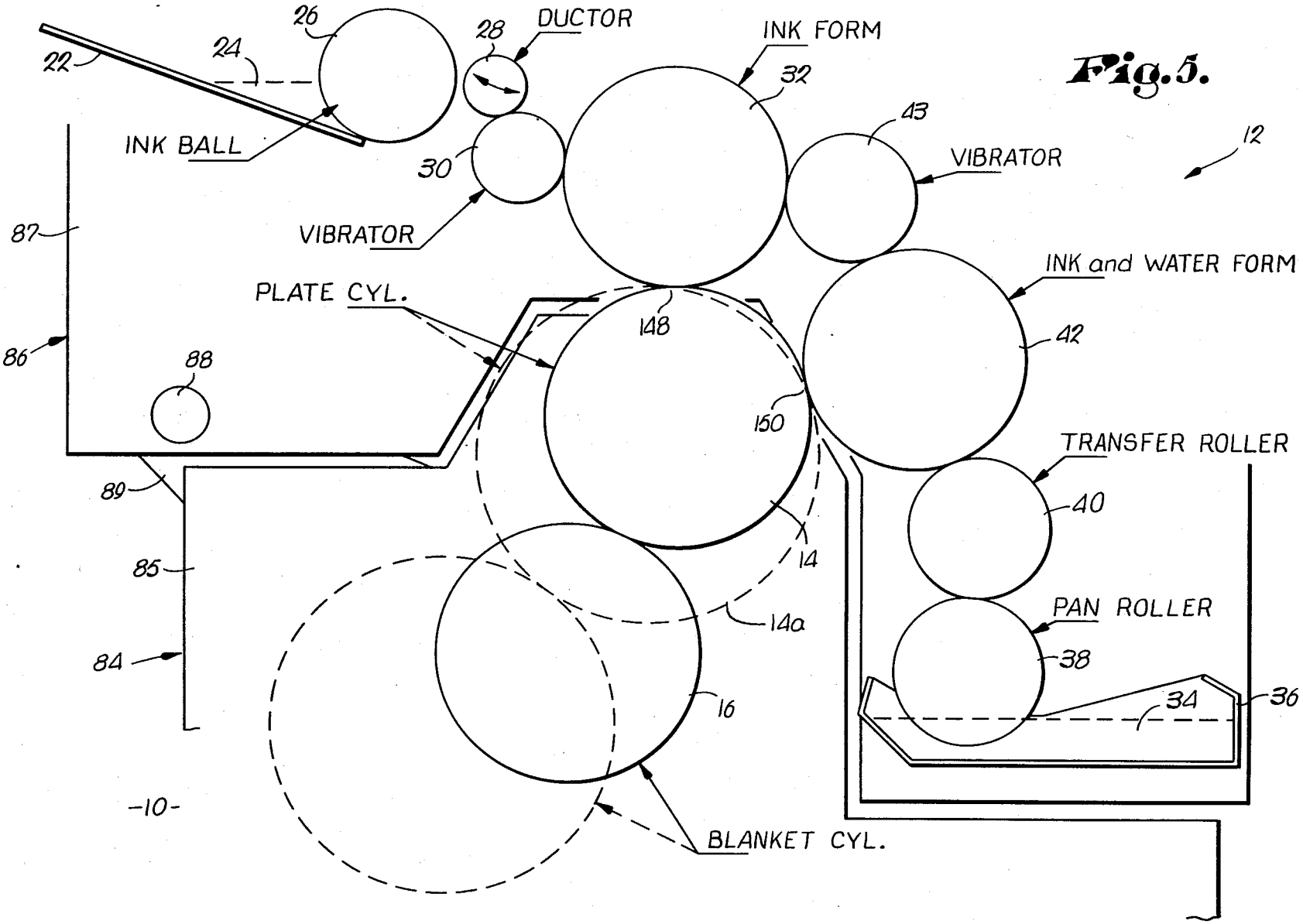
FIG. 5 is another schematic showing of the dual form planetary inker embodying the basic principals of the invention and depicting the two point contact of the plate cylinder with the inker such that various plate diameters may be utilized.

Further effectiveness of the instant invention over prior art inkers is disclosed by reference to FIG. 5. The inker 12 advantageously contacts the plate 14 only at the nips 148, 150. As such, the plate cylinder 14 may be removed and replaced with a second plate cylinder 14*a* having any one of a number of different diameters. As a result, the two point contact of the inker 12 provides numerous manufacturing as well as operational advantages, since the press 10 may thus be utilized to provide a working image size of various dimensions. Prior art non-planetary inkers were typically provided with a number of distributor rollers in rolling engagement with the plate cylinder in an effort to mill the ink to a uniform film. In contrast, the planetary inker has a plurality of distributor rollers in rolling contact with the form cylinders whereby the necessity of additional distributor rollers in engagement with the plate cylinder is eliminated.

The utilization of the two forms 32, 42 prevents excessive build-up of dampening solution 34 within the inker 12. In a single form planetary inking system of the prior art, water applied directly to the form would overmix with the ink and excessively emulsify, and thus "wash out" the image by precluding good ink transfer. On the other hand, application of the water directly to the plate by a roller would establish a two-point contact, such that if a second form roller were utilized to prevent "hickies", a three-point contact would exist and thereby prohibit any convenient alteration of plate diameter.

In addition, the planetary inker of this invention has been advantageously provided with a gear drive to insure positive rolling displacement of the form cylinders 32, 42 during rolling engagement with the plate cylinder 14. It has been found that if the form rollers slip, toning or scuffing may result. Toning occurs when the form roller slips and water is pressed out of the nip such that speckles of ink may be subsequently deposited on the non-image areas of the plate. On the other hand, scuffing occurs when the form roller slips on the plate, whereby the printed image will have streaks or lines.

The instant invention also eliminates ghosting that has plagued the operation of prior art offset presses. It is of utmost importance that the ink film is of uniform thickness before the film is transferred to the plate cylinder 14, and also it is important that both of the forms 32, 42 are operable to provide a one-hundred percent ink transfer to the plate 14 when ink demands are high. The inker 12 with its unique arrangement of distributor rollers around the rotating forms 32, 42 insure that the ink film is completely milled to an even layer as the forms 32, 42 rotate, while the ink-storage capabilities of the distributor rollers are operable to quickly respond to heavy ink demands where the film on the forms 32, 42 has been depleted by the plate 14.

We claim:

1. In an offset printing press having a blanket cylinder, a plate cylinder disposed to rotate in rolling contact with said blanket cylinder, a source of dampening solution, and an ink fountain, the combination therewith of a dual form planetary inker comprising:

a pair of side-by-side form rollers out of engagement with one another and each disposed for rolling engagement with said plate cylinder to each form a nip with said plate cylinder, the rotational axis of one of said form rollers being fixed relative to the rotational axis of the other;

gear means interconnecting said form rollers with said plate cylinder and being operable to rotate said form rollers at essentially the same surface velocity as the surface velocity of said plate cylinder;

a series of distributor rollers, a certain quantity of said distributor rollers being positioned for rolling contact with one of said form rollers and a certain other number of said distributor rollers being disposed for rolling engagement with the other of said form rollers, at least one of said quantity of distributor rollers being a longitudinally oscillatable roller in contact with one of said form rollers and at least one of said number of distributor rollers being a longitudinally oscillatable roller in contact with the other of said form rollers, one of said distributor rollers being operably associated with said ink fountain and functioning as a supply roller for delivering ink to one of the form rollers for delivery to the plate cylinder at a controlled rate, said dampening solution source being operably associated with one of said form rollers for dampening non-image areas of said plate cylinder and thus preclude deposition of ink thereon ;and ink transfer roller means in continuous bridging rolling engagement with both of said form rollers for also transferring ink to the plate cylinder along a path from the form roller in engagement with said ink supply roller via the ink transfer roller means and the other form roller direct to the plate cylinder, said ink transfer roller means including at least one longitudinally oscillatable vibrator roller having an axis of rotation fixed relative to the rotational axes of said form rollers, whereby two separate, continuous pathways for transfer of ink to the plate cylinder are presented during operation of the press for printing, with both of the form rollers being continuously supplied with ink that is constantly smoothed by said distributor rollers before subsequent transfer to said plate cylinder at each of the form roller nips thereon.

2. The invention of claim 1 , wherein a quantity of non-oscillatable rider rollers are positioned for rolling contact with said bridging ink transfer roller means.

3. The invention of claim 1; including a support rotatably carrying said blanket cylinder and said plate cylinder; and a frame pivotally coupled to said support and carrying said pair of form rollers, said frame being swingable in an arc between a first position wherein both of said forms are disposed for rolling contact with said plate cylinder and a second position wherein both of said forms are spaced from said plate cylinder, said forms being positioned on said frame such that as said frame is shifted from said second position toward said first position, said one form roller operably associated with said dampening solution source moves in substantially tangential relationship to said plate cylinder for ensuring said plate cylinder receives sufficient dampening solution before the other of said form rollers contacts said plate cylinder.

* * * * *